United States Patent [19]

King et al.

[11] Patent Number: 4,942,120

[45] Date of Patent: Jul. 17, 1990

[54] MODIFIED PEPTIZER TWINNED GRAIN SILVER HALIDE EMULSIONS AND PROCESSES FOR THEIR PREPARATION

[75] Inventors: Scott A. King, Penfield; Philip I. Rose; Joe E. Maskasky, both of Rochester, all of N.Y.

[73] Assignee: Eastman Kodak Company, Rochester, N.Y.

[21] Appl. No.: 345,050

[22] Filed: Apr. 28, 1989

[51] Int. Cl.[5] ..... G03C 1/02

[52] U.S. Cl. ..... 430/567; 430/569; 430/642

[58] Field of Search ..... 430/567, 569, 642

[56] References Cited

U.S. PATENT DOCUMENTS 4,713,320 12/1987 Maskasky ..... 430/567

4,713,323 12/1987 Maskasky ..... 430/569

OTHER PUBLICATIONS

*Research Disclosure,* vol. 176, Dec., 1978, Item 17643, Section IX, Vehicles and Vehicle Extenders.

*Research Disclosure,* vol. 225, Jan., 1983, Item 22534.

E. Klein et al, *Fotografische Korrespondenz,* 99 (7), 99–102 (1963).

*Primary Examiner*—Paul R. Michl

*Assistant Examiner*—Janet C. Baxter

*Attorney, Agent, or Firm*—Carl O. Thomas

[57] ABSTRACT

The present invention is directed to a process of precipitating for use in photography a silver halide emulsion employing a gelatino-peptizer containing alkylated methionine and to an emulsion produced by this process. A variety of advantages can be realized, including an increase in the population of twinned grains and a higher yield of thin tabular grains.

21 Claims, No Drawings

MODIFIED PEPTIZER TWINNED GRAIN SILVER HALIDE EMULSIONS AND PROCESSES FOR THEIR PREPARATION

BACKGROUND OF THE INVENTION

1. Field of the Invention

The invention relates to radiation sensitive silver halide emulsions useful in photography and to processes for their preparation.

2. Background

The most commonly employed photographic elements are those which contain a radiation sensitive silver halide emulsion layer coated on a support. Although other ingredients can be present, the essential components of the emulsion layer are radiation sensitive silver halide microcrystals, commonly referred to as grains, which form the discrete phase of the photographic emulsion, and a vehicle, which forms the continuous phase of the photographic emulsion.

It is important to recognize that the vehicle encompasses both the peptizer and the binder employed in the preparation of the emulsion layer. The peptizer is introduced during the precipitation of the grains to avoid their coalescence or flocculation. Peptizer concentrations of from 0.2 to 10 percent, by weight, based on the total weight of emulsion as prepared by precipitation, can be employed.

It is common practice to maintain the concentration of the peptizer in the emulsion as initially prepared below about 6 percent, based on total emulsion weight, and to adjust the emulsion vehicle concentration upwardly for optimum coating characteristics by delayed binder additions. For example, the emulsion as initially prepared commonly contains from about 5 to 50 grams of peptizer per mole of silver, more typically from about 10 to 30 grams of peptizer per mole of silver. Binder can be added prior to coating to bring the total vehicle concentration up to 1000 grams per mole of silver. The concentration of the vehicle in the emulsion layer is preferably above 50 grams per mole of silver. In a completed silver halide photographic element the vehicle preferably forms about 30 to 70 percent by weight of the emulsion layer. Thus, the major portion of the vehicle in the emulsion layer is typically not derived from the peptizer, but from the binder that is later introduced.

While a variety of hydrophilic colloids are known to be useful peptizers, preferred peptizers are gelatin—e.g., alkali-treated gelatin (cattle bone or hide gelatin) or acid-treated gelatin (pigskin gelatin)—and gelatin derivatives—e.g., acetylated gelatin or phthalated gelatin. Gelatin and gelatin derivative peptizers are hereinafter collectively referred to as "gelation-peptizers".

Materials useful as peptizers, particularly gelatin and gelatin derivatives, are also commonly employed as binders in preparing an emulsion for coating. However, many materials are useful as vehicles, including materials referred to as vehicle extenders, such as latices and other hydrophobic materials, which are inefficient peptizers. A listing of known vehicles is provided by Research Disclosure, Vol 176, Dec. 1978, Item 17643, Section IX, Vehicles and vdhicle extenders. Research Disclosure is published by Kenneth Mason Publications, Ltd., Emsworth, Hampshire P010 7DD, England.

Interest in silver halide photography has focused on twin-plane grain emulsions, particularly high aspect ratio octahedral tabular grain emulsions having two or more parallel twin planes. It has been shown that these emulsions can produce a variety of photographic advantages, including increased sharpness, improved speed-granularity relationships, increased blue and minus blue speed separations, more rapid developability, higher silver covering power when fully forehardened, reduced crossover in spectrally sensitized Duplitized TM (two sided) radiographic formats, and various imaging advantages in dye image transfer film units. Research Disclosure, Vol. 225, Jan. 1983, Item 22534, is considered representative of these teachings.

The formation of twin-plane silver halide crystals in photographic emulsion has been described by E. Klein et al in *Fotografische Korrespondenz*, 99 (7), 99–102 (1963).

Maskasky U.S. Pat. Nos. 4,713,320 and 4,713,323, are directed to tabular grain silver brom(oiod)ide (silver bromide and silver bromoiodide) and chlor(obrom)ide (silver chloride and silver chlorobromide) emulsions and processes for their preparation employing a gelatino-peptizer treated with an oxidizing agent to convert the divalent sulfur atom of the methionine to a tetravalent sulfinyl or hexavalent sulfonyl form.

The present invention offers an alternative approach for improving the characteristics of photographic silver halide emulsions prepared in the presence of methionine containing gelatino-peptizers.

SUMMARY OF THE INVENTION

It has been discovered that lowering the methionine content of gelatino-peptizer by alkylation of its methionine component increases twinning of the silver halide grains formed in the presence of the modified peptizer. Alkylation converts the methionine's divalent sulfur atom to an alkylsulfonium ion. This reduction in methionine increases the likelihood of twinning, and therefore the creation of a greater twin population among silver halide grains.

We have also found that the alkylation of methionine in gelation-peptizers leads to an increased yield of thin tabular grains during the silver halide emulsion precipitation.

In one aspect this invention is directed to a photographic emulsion comprising silver halide grains and a gelatino-peptizer, characterized in that at least 50 percent of the silver halide grains, based on total grain projected area, contain twin planes and the gelatino-peptizer contains alkylated methionine.

In another aspect this invention is directed to a process comprising forming silver halide grains in the presence of a gelatino-peptizer under conditions which favor the formation of at least some grains containing twin planes, wherein the gelatino-peptizer initially contains methionine, characterized in that the methionine of the gelatino-peptizer is at least partially alkylated prior to forming the silver halide grains, so that the proportion of twin plane containing grains formed is increased.

In a more specific aspect this invention relates specifically to tabular grain emulsions and their preparation.

It is an advantage of the present invention that silver halide grains are produced having an increased population of twin crystals. Also, thin tabular grain silver halide emulsions can be prepared having thinner tabular grains than can be attained by otherwise comparable precipitation procedures wherein the methionine component of the gelatino-peptizer has not been reduced.

Additionally, the present invention allows tabular grain silver halide emulsions to be precipitated over a wider range of halide ion concentrations.

DESCRIPTION OF PREFERRED EMBODIMENTS

The present invention offers an alternative to the teachings of Maskasky U.S. Pats. No. 4,713,320 and 4,713,323, cited above and here incorporated by reference. It has been discovered that instead of treating methionine containing gelatino-peptizer with an oxidizing agent to achieve enhancement of twin plane formation in the silver halide grains, it is instead possible to improve emulsion grain properties by treating the methionine containing gelatino-peptizer with an alkylating agent.

The alkylation treatment of gelatino-peptizers eliminates or lowers the concentration of the methionine by alkylating the divalent sulfur atom in the molecule. Thus, the divalent sulfur atoms are converted to an alkylsulfonium group.

Any alkylating agent capable of converting divalent sulfur to a sulfonium ion under appropriate conditions is operable within the scope of this invention.

While any of a variety of alkylating agents can be employed, iodo compounds, such as methyl iodide and iodoacetic acid, are preferred alkylating agents. Appropriate levels of alkylating agents are readily determined knowing the initial concentration of methionine in the gelatino-peptizer to be treated. An excess of alkylating agent can be employed without adverse effect.

The following are representive of contemplated alkylating agents:

Iodoacetic acid
Iodoacetamide
Iodoacetate
Bromoacetate
Iodomethane
Bromoacetanilide
Alkyl halides, such as ethylbromide, butylchloride
Benzylchloride
Phenyl chloromethyl ketone
Benzyl chloromethyl ketone
Aziridines
Haloalkenes, such as $CH_2{=}CHCH_2I$, $CH_2{=}CHCH_2Br$
Methylsulfonate ($Me_2SO_4$)
Alkoxybenzenes, such as $C_6H_5OCH_3$, $C_6H_5OCH_2CH_3$
Silyloxyester enolates, such as $CH_2{=}C(OMe)OSiMe_3$
Trialkyloxonium ions
$MeSO_3H$
$CF_3SO_3H$
Aromatic-alpha-bromoamides, such as bromoacetyl-aniline and bromoacetyl-indoline
Dimethylnitrosamine
4-(trifluoromethyl)-alpha-bromoanilide Typical procedures for alkylating methionine with methyl iodide and iodoacetic acid have been described by (a) T. P. Link et al in L. Bio. Chem., 243(6), 1082 (1968) and
(b) H.G. Gundlach et al, in J. Bio. Chem., 234(7), 1761 (1959), respectively.

Although the methionine content of gelatin can vary widely, depending upon its origin, typically untreated gelatin contains methionine in concentrations well above 30 micromoles per gram. Alkylation is preferably undertaken to reduce residual unalkylated methionine to a concentration below 30 micromoles per gram, most preferably below 12 micromoles per gram, and optimally below 5 micromoles per gram. However, even when alkylation of methionine is ioncomplete, reduction in methionine concentrations results in demonstrable advantages when compared to samples of the initial, untreated gelatino-peptizer.

The invention has general applicability to the preparation of silver halide emulsions containing twinned grains—i.e., grains containing one or more twin planes. The invention has particular applicability to the preparation of tabular grain emulsions. Preferred tabular grain emulsions are those in which tabular grain account for at least 50 percent of the total grain projected area and satisfy the relationship:

$$\frac{D}{t^2} > 25 \qquad \text{(I)}$$

where

D is the average tabular grain diameter expressed in micrometers and
t is the average tabular grain thickness expressed in micrometers.

For thin tabular grain emulsions, those in which t is less than 0.2 μm, any emulsion having an average tabular grain aspect ratio (D/t) of at least 5 satisfies relationship (I). All high aspect ratio tabular grain emulsions, those in which tabular grains having a thickness of less than 0.3 μm having an average aspect ratio of greater than 8 and account for greater than 50 percent of the total grain projected area, satisfy relationship (I). Preferred tabular grain emulsions are those in which the tabular grains account for at least 70 percent and, optimally, at least 90 percent of the total grain projected area. D/t2 of preferred tabular grain emulsions is at least 40 and, optimally, at least 60, with D/t2 values of up to 1000 or even higher being contemplated. According to the customary practice of the art, the average tabular grain diameter is the diameter of a circle having the same projected area.

It is specifically contemplated to prepare tabular grain emulsions satisfying relationship (I) by alkylating as described above the methionine containing gelatino-peptizers of, but otherwise following the teachings of, Wilgus et al U.S. Pat. No. 4,434,226; Kofron et al U.S. Pat. No. 4,439,520; Daubendiek et al U.S. Pat. No. 4,414,310; Abbott et al U.S. Pat. Nos. 4,425,425 and 4,425,426; Solberg et al U.S. Pat. No. 4,433,048; Dickerson U.S. Pat. No. 4,414,304; Jones et al U.S. Pat. No. 4,478,929; Maskasky U.S. Pat. No. 4,435,501; and Research Disclosure, Vol. 225, Jan. 1983, Item 22534, and Vol. 232, Aug. 1983, Item 23206; each of which are incorporated by reference.

Subject to methionine level requirements set forth above, the preferred gelatino-peptizer for use in the practice of this invention is gelatin. Of the various modified forms of gelatin, acetylated gelatin and phthalated gelatin consitutue preferred gelatin derivatives. Specific useful forms of gelatin and gelatin derivatives can be chosen from among those disclosed by Yutzy et al U.S. Pat. Nos. 2,614,928 and 2,614,929; Lowe et al U.S. Pat. Nos. 2.614,930 and 2.614,931; Gates U.S. Pat. Nos. 2,787,545 and 2,956,880; Ryan U.S. Pat. No. 3,186,846;

Dersch et al U.S. Pat. No. 3,436,220; and Luciani et al U.K. Patent No. 1,186,790.

In one form, precipitations according to the invention concurrently introduce into a reaction vessel silver, bromide, and, optionally, iodide ions to precipitate the desired thin tabular grain silver brom(oiod)ide emulsion. The reaction vessel initially contains water as a dispersing medium. A relatively small amount of bromide ion is introduced into the reaction vessel to produce the desired initial pBr. Since very small grains can be held in suspension without a peptizer, peptizer can be added after grain formation has been initiated, but in most instances it is preferred to add at least 10 percent and, most preferably at least 20 percent, of the peptizer present at the conclusion of precipitation to the reaction vessel before grain fromation occurs. The low methionine gelatino-peptizer is preferably the first peptizer to come into contact with the silver halide grains. Gelatino-peptizers with conventional methionine levels can contact the grains prior to the low methionine gelatino-peptizer, provided they are maintained below concentration levels sufficient to peptize the tablular grains produced. For instance, any gelatino-peptizer with a conventional methionine level of greater than 30 micromoles per gram initially present is preferably held to a concentration of less than 1 percent of the total peptizer employed. While it should be possible to use any conventional peptizer toward the end of precipitation with minimal adverse impact on the emulsions, it is preferred that the low methionine gelatino-peptizer be used as the sole peptizer throughout the formation and growth of the thin tabular grain emulsion.

Silver, bromide, and, optionally, iodide ions are concurrently run into the reaction vessel. The silver ions are preferably supplied in an aqueous solution of silver nitrate. The bromide and iodide ions are preferably supplied, separately or together, in aqueous solutions of ammonium or alkali metal salts. Mignot U.S. Pat. No. 4,334,012, which is concerned with ultrafiltration during emulsion precipitation and here incorporated by reference, sets forth a variety of preferred procedures for managing the introduction of gelatino-peptizer, silver, bromide, and iodide ions during emulsion precipitations. Introduction of silver and halide ions in the form of a Lippmann emulsion, as taught by Mignot, is specifically contemplated. In forming silver brom(oiod)ide emulsions according to the invention, the procedures of Maskasky U.S. Pat. No. 4,713,320, cited above and here incorporated by reference, can be employed, except that alkylated methionine containing gelatino-peptizer is substituted in whole or in part for oxidized methionine containing gelatino-peptizer. As disclosed by Maskasky U.S. Pat. No. 4,713,320, the pBr within the reaction vessel is maintained in the range of from 1.6 to 2.4 at the time the tabular grains are being formed.

In another form, precipitations according to the invention introduce silver ion into a reaction vessel containing at least 0.5 molar concentration of chloride ion while employing an alkylated gelatino-peptizer.

At the beginning of precipitation the chloride ion in the reaction vessel is at least 0.5 molar, but can range upwardly to the saturation level of the soluble salt used to supply the chloride ion. In practice it is preferred to maintain the chloride ion concentration below saturation levels to avoid elevated levels of viscosity of the aqueous solution in the reaction vessel. Preferred chloride ion concentration levels are in the range of from 0.5 to 2.0 molar, optimally from about 0.5 to 1.5 molar.

The chloride ion can be provided by any soluble chloride salt known to be useful in grain precipitation. Alkali metal (e.g., lithium, sodium, or potassium) or alkaline earth metal (e.g., magnesium, calcium, or barium) can be employed as counter ions for the chloride ions. It is also possible to employ ammonium counter ions; however, when the intent is to form thin tabular grains and ammonium ions are employed, the pH within the reaction vessel is kept on the acid side on neutrality to avoid the presence of ammonia, which acts as a ripening agent and contributes to thickening the tabular grains.

Silver chlor(obrom)ide emulsions can be prepared by either double-jet or single-jet techniques. By placing sufficient chloride ion initially in the reaction vessel to react with silver ion introduced while still maintaining the concentration of chloride ion in the reaction vessel above 0.5 molar, it is possible to prepare high aspect ratio tabular grain emulsions according to this invention without the further addition of halide ion. That is, high aspect ratio tabular grain silver chloride emulsions according to this invention can be prepared by single jet precipitation merely by introducing a conventional water soluble silver salt, such as silver nitrate.

It is, of course, possible to introduce additional chloride ion into the reaction vessel as precipitation progresses. This has the advantage of allowing the chloride concentration level of the reaction vessel to be maintained initially at or near the optimum molar concentration level. Thus, double jet precipitation of high aspect ratio tabular grain silver chloride emulsions is contemplated. Conventional aqueous chloride salt solutions containing counter ions as identified above can be employed for the chloride ion jet.

Since silver bromide and silver iodide are markedly less soluble than silver chloride, it is appreciated that bromide and/or iodide ions if introduced into the reaction vessel will be incorporated in the grains in preference to the chloride ions. Thus, by employing bromide or iodide salts corresponding to the chloride salts described above in combination with the chloride ions, it is possible to prepare high aspect ratio tabular grain emulsions in which the tabular grains also contain one or more other halides or even contain no measurable amounts of chloride. For example, a high aspect ratio tabular grain emulsion has been prepared according to this invention in which 100 mole percent bromide is present, based on silver. High aspect ratio tabular grain emulsions have also been prepared in which both chloride and bromide ions are present in the grains. Thus, high aspect ratio tabular grain emulsions ranging from those containing chloride as the sole halide to those containing bromide as the sole halide as well as all intermediate proportions of chloride and bromide are made possible by this invention. The preferred high aspect ratio tabular grain silver chlor(obrom)ide emulsions according to the present invention are those which contain at least a small amount of bromide in addition to chloride. It is preferred to employ a bromide ion concentration in the reaction vessel prior to silver ion introduction of at least $2.5\times10^{-3}$M. To increase the concentration of the bromide in the tabluar silver chlor(obrom)ide grains the concentration of bromide ions in the reaction vessel can be increased or additional bromide ions can be introduced while precipitation is occurring. As demonstrated by the examples, high aspect ratio tabular grain silver chlorobromide emulsions having tabular grain thicknesses of 0.2 μm and less have been formed according to this invention containing as little as 0.5 mole percent bromide, based on silver.

It has been further demonstrated that the practice of this invention is compatible with the incorporation of minor amounts of iodide in the silver chlor(obrom)ide tabular grains, preferably up to about 1 mole percent or less, based on silver. Iodide ion is preferably incorporated into the tabular grains by introducing iodide ion into the reaction vessel while precipitation is occurring.

Silver chloride favors the formation of {100} crystal faces, which are incompatible with the desired {111} crystal faces needed for tabular grain formation. To insure that tabular grains are formed when silver chloride is being precipitated, a grain growth modifier is employed. Any one of the grain growth modifiers disclosed by Maskasky U.S. Pat. No. 4,400,463 can be employed for this purpose, the disclosure of which is here incorporated by reference. While small quantities of iodide ion can act as a growth modifier, it is generally preferred to employ an aminoazaindene. Specifically preferred aminoazaindenes for use in the practice of this invention are those having a primary amino substituent attached to a ring carbon atom of a tetraazaindene, such as adenine and guanine, also referred to as aminopurines. While aminoazaindenes can be employed in concentrations as high as 0.1 mole per mole of silver, as taught by Maskasky U.S. Pat. No. 4,400,463, cited above, it is a surprising feature of this invention that aminoazaindene concentrations of an order of magnitude less than those of Maskasky U.S. Pat. No. 4,400,463 are effective. Useful aminoazaindene concentrations as low as $10^{-4}$ mole per mole of silver are effective. It is generally preferred to maintain from about $0.5\times10^{-3}$ to $5\times10^{-3}$ mole of aminoazaindene per mole of silver in the reaction vessel during precipitation.

Once the emulsion is formed the aminoazaindene is no longe rrequired, but at least a portion typically remains adsorbed to the grain surfaces. Compounds which show a strong affinity for silver halide grain surfaces, such as spectral sensitizing dyes, may displace the aminoazaindene, permitting the aminoazaindene to be substantially entirely removed from the emulsion by washing. Since azaindenes are well known as excellent antifoggants, their retention in the emulsions as formed can be advantageous.

From the foregoing it is apparent that the preparation of silver chlor(obrom)ide emulsions can be undertaken by procedures similar to those described by Maskasky U.S. Pat. No. 4,713,323, cited above and here incorporated by reference, except that gelatino-peptizer containing an alkylated methionine component is substituted in whole or in part for gelatino-peptizer containing an oxidized methione component. Further, to the extend that more highly twinned grains rather than tabular grains are sought, a somewhat broader range of preparation conditions are feasible.

Except for the distinguishing features discussed above, precipitations according to the invention can take conventional forms, such as those described by Research Disclosure, Vol. 176, Dec. 1978, Item 17643, Section I, or U.S. Pat. Nos. 4,399,215; 4,400,463; and 4,414,306, cited above. Since very small grains can be held in suspension without a peptizer, peptizer can be added after grain formation has been initiated, but in most instances it is preferred to add at least 5 percent and, most preferably, at least 10 percent of the peptizer present at the conclusion of precipitation to the reaction vessel before grain formation occurs. The alkylated methionine gelatino-peptizer is preferably the first peptizer to come into contact with the silver halide grains.

Modifying compounds can be present during emulsion precipitation. Such compounds can be initially in the reaction vessel or can be added along with one or more of the peptizer and ions identified above. Modifying compounds, such as compounds of copper, thallium, lead, bismuth, cadmium, zinc, middle chalcogens (i.e., sulfur, selenium, and tellurium), gold, and Group VIII noble metals, can be present during precipitation, as illustrated by Arnold et al U.S. Pat. No. 1,195,432; Hochstetter U.S. Pat. No. 1,951,933; Trivelli et al U.S. Pat. No. 2,448,060; Overman U.S. Pat. No. 2,628,167; Mueller et al U.S. Pat. No. 2,950,972; Sidebotham U.S. Pat. No. 3,488,709; Rosecrants et al U.S. Pat. No. 3,737,313; Berry et al U.S. Pat. No. 3,772,031; Atwell U.S. Pat. No. 4,269,927; and *Research Disclosure*, Vol. 134, Jun. 1975, Item 13452. It is also possible to introduce one or more spectral sensitizing dyes into the reaction vessel during precipitation, as illustrated by Locker et al U.S. Pat. No. 4,225,666.

The emulsions according to this invention can be put to photogaphic use as precipitated, but are in most instances adapted to serve specific photographic applications by procedures well known in the art. It is important to note that once an emulsion has been prepared as described above any conventional vehicle, including gelatin and gelatin derivatives of higher methionine levels, can be introduced while still realizing all of the advantages of the invention described above. Also the emulsions can be blended with other silver halide emulsions, as illustrated by *Research Disclosure*, Item 17643, cited above, Section I, Paragraph F, and Dickerson U.S. Pat. No. 4,520,098, cited above. Other useful vehicle materials are illustrated by *Research Disclosure*, Item 17643, Section IX, cited above. Conventional hardeners can be used, as illustrated by Item 17643, Section X. The emulsions can be washed following precipitation, as illustrated by Item 17643, Section II. The emulsions can be chemically and spectrally sensitized as described by Item 17643, Sections III and IV; however, the emulsions are preferably chemically and spectrally sensitized as taught by Kofron et al U.S. Pat. No. 4,439,520 and Maskasky U.S. Pat. No. 4,435,501, both cited above. The emulsions can contain antifoggants and stabilizers, as illustrated by Item 17643, Section VI.

The emulsions of this invention can be used in othewise conventional photographic elements to serve varied applications, including black-and-white and color photography, either as camera or print materials; image transfer photography; photothermography; and radiography. The remaining sections of *Research Disclosure*, Item 17643, illustrate features particularly adapting the photographic elements to such varied applications.

EXAMPLES

The invention can be better appreciated by reference to the following specific examples. Except as otherwise noted the gelatin employed as a starting material prior to the alkylation treatment, if any, contained approximately 55 micromoles of methionine per gram.

EXAMPLE 1

This example illustrates that use of a methylated gelatin during precipitation of a silver bromoiodide emulsion (six mole percent iodide, based on silver) gives greater yield of crystals containing twin planes than does use of an unmodified control gelatin, and particularly increases the yield of tabular grains.

Emulsion 1A: A Control Emulsion

The precipitation vessel was charged with 4023 gm of an aqueous solution containing 11.2 gm deionized bone gelatin and 11.9 gm NaBr. The temperature was adjusted to 75° C. and the pH to 5.50. With stirring, 2M $AgNO_3$ and 2M NaBr were added over a period of two minutes at a rate of 0.02 mole/minute. Following one minute wherein no reagents were added, 1306 gm of aqueous solution containing 44.4 gm deionized bone galatin and 11.9 gm NaBr was added over a period of thirty seconds. 1.5 minutes after completing this addition, 2.96 mol of 2M $AgNO_3$ was added over a period of 54.5 minutes using a linearly accelerating flow (10× from start to finish); a balanced flow of 1.88M NaBr and 0.12M KI was maintained during this addition. The flow rates attained at the end of this addition were maintained for 30 minutes to complete the precipitation of six moles of AgBrI (6 mole % iodide, based on silver) emulsion. D/t2 was 292.

Emuslion 1B: An Example Emulsion

This emulsion was prepared identically to Emulsion 1A, except that the gelatin used to initially charge the precipitation vessel was pretreated as follows: To 400 gm of five percent bone gelatin was added 15 ml methyl iodide. The mixture was stirred vigorously at 40° C. for six hours, then held under reduced pressure for 45 minutes to remove some excess alkylating agent. A mixture of strong acid cation exchange resin and strong base anion exchange resin was used for deionization, after which the sample was lyophilized and stored for use.

The emulsion had a mean tabular grain diameter of 2.6 μm and a mean tabular grain thickness of 0.07 μm. D/t2 was 531.

Results

Control Emulsion 1A contained 41 percent tabular grains and two percent twinned, non-tabular grains; hence 43 pecent of the grains contained twin planes, while 57 percent contained none. Example Emulsion 1B contained 77 percent tabular grains and three percent twinned, non-tabular grains; hence 80 percent of the grains contained twin planes, while 20 percent did not.

The invention emulsion therefore contained only 35 percent as many untwinned crystals as did the control emulsion.

The population of tabular grains benefitted particularly from the invention, manifesting a 1.9× increase in tabular grains (by number) relative to the control.

EXAMPLE 2

This example illustrates that the use of alkylated gelatin—even in a small quantity at the beginning of this precipitation—increases the yield of twinned silver bromide crystals, and tabular grains in particular.

Emulsion 2A: A Control Emulsion

The precipitation vessel was charged with 4023 gm of an aqueous solution containing 11.2 gm deionized bone gelatin and 11.9 gm NaBr. The temperature was adjusted to 75° C. and the pH to 5.50. With stirring, 2M $AgNO_3$ and 2M NaBr were added over a period of two minutes at a rate consuming 1.3 percent of the total silver used in precipitation. Following one minute wherein no reagents were added, 1325 gm of aqueous solution containing 61.6 gm deionized bone gelatin and 13.3 gm NaBr was added over a period of thirty seconds. 1.5 minutes after completing this addition, the remainder of the total of 3 moles of silver was added over a period of 54.5 minutes at constant pBr of 1.34, and using linearly accelerating flow (10× from start to finish).

The emulsion had a mean tabular grain diameter of 3.1 μm and a mean tabular grain thickness of 0.075 μm. D/t2 was 554.

Emulsion 2B: An Example Emulsion

This emulsion was prepared identically to Emulsion 2A, except that the gelatin used to charge the precipitation vessel was pretreated as follows: To 4000 gm of five percent bone gelating (pH 4.0) was added 168 gm 10.7 percent aqueous iodoacetic acid. The mixtture was stirred for 6.5 hours at 40° C., then deionized using a mixture of strong acid cation exchange resin and strong base anion exchange resin. It was then lyophilized and stored for use. The emulsion had a mean grain diameter of 2.6 μm and a mean grain thickness of 0.07 μm D/t2 was 530.

Results

Control Emulsion 2A contained 31 percent tabular grains and 12 percent twinned, non-tabular grains; hence 43% of the grains contained twin planes while 57 percent contained none. Example Emulsion 2B contained 67 percent tabular grains and five percent twinned, non-tabular grains; hence 72 percent of the grains contained twin planes, while 18 percent contained none. The invention emulsions therefore contain less than a third the population of untwinned crystals of the control emulsion. The population of tabular grains increased by over 60 percent in the invention emulsion relative to the control. It should be noted that these advantages accrue from use of the alkylated gelatin even though it represented less than a sixth of the total gelatin present during precipitation.

EXAMPLE 3

This example illustrates the preparation of tabular grain AgClBr (one percent Br) emulsions by a single-jet precipitation in the presence of alkylated gelatino-peptizer. A comparative control emulsion was also prepared in which the grains were nontabular.

Emulsion 3A: A Control Emulsion

The reaction vessel, equipped with a stirrer, was charged with 400 g of an aqueous solution containing one percent of deionized bone gelatin, 0.001 mole NaBr, 0.11 millimole adenine and 0.5M in $CaCl_2$. The pH was adjusted to 3.8 at 55° C. and maintained at that value throughout the precipitation by addition of NaOH solution as required. A 2.0M $AgNO_3$ solution was added over a one minute period at a rate consuming 1.0 percent of the total Ag used. The addition rate was then linearly accelerated over an additional period of 22 minutes (7.7× from start to finish) during which time the remaining 99.0 percent of the Ag was consumed. When 2.2, 8.0 and 50 percent of the Ag had been added, two mL of a 37 mM adenine solution was added. A total of 0.1 mole Ag was consumed in the precipitation.

Results

The resulting emulsin contained a nontabular grain population and a tabular-like grain population. This tabular-like grrain population consisted of grains having a mean grain diameter of 2.0 μm and a mean thickness of 0.50 μm. D/t2 was 8. Less than 10 percent of the total grain projected area of the emulsion was accounted for by grains which exhibited a thickness of 0.3 μm or less.

Emulsion 3B: An Example Emulsion

The procedure described for the preparation of Emuslion 3A was repeated, except that the gelatin used to charge the reaction vessel was pretreated with methyl iodide as described under 1B of Example 1.

Results

The resulting emulsion contained tabular grains having a mean grain diameter of 2.8 μm and a mean thickness of 0.24 μm. D/t2 was 49. More than 60 percent of the total projected area of the emulsion grains was accounted for by tabular grains of a thickness 0.3 μm or less.

Emulsion 3C: A Example Emulsion

The procedure described for the preparation of Emulsion 3A was repeated, except that the gelatin used to initially charge the reaction vessel was pretreated with iodoacetic acid as described under 2B of Example 2.

Results

The resulting emulsion contained tabular grains having a mean grain diameter of 2.5 μm and a mean thickness of 0.23 μm. D/t2 was 47. More than 60 percent of the total projected area of the emulsion grains was accounted for by tabular grains of a thickness 0.3 μm or less.

The invention has been described in detail with particular reference to preferred embodiments thereof, but it will be understood that variations and modifications can be effected within the spirit and scope of the invention.

What is claimed is:

1. a photographic emulsion comprising silver halide grains and a gelatino-peptizer, characterized in that at least 50 percent of the silver halide grains, based on total grain projected area, contain twin planes and the gelatino-peptizer contains alkylated methionine.

2. A photographic emulsion according to claim 1 further characterized in that tabular silver halide grains account for greater than 50 percent of the total grain projected area of said gelatin emulsion and satisfy the relationship:

$$\frac{D}{t^2} > 25$$

where

D represents the average tabular grain equivalent circular diameter expressed in micrometers and t represents the average tabular grain thickness expressed in micrometers.

3. A photographic emulsion according to claim 1 further characterized in that the silver halide grains are comprised of silver bromide.

4. A photographic emulsion according to claim 3 further characterized in that the grains additionally contain iodide ions.

5. A photographic emulsion according to claim 3 further characterized in that the grains additionally contain chlordie ions.

6. A photographic emulsion according to claim 1 further characterized in that the silver halide grains are comprised of silver chloride.

7. A photographic emulsion according to claim 6 further characterized in that the grains additionally contain bromide ions.

8. A photographic emulsion according to claim 1 further characterized in that the gelatino-peptizer contains less than 30 micromoles of non-alkylated methionine per gram.

9. A photographic emulsion according to claim 1 further characterized in that the gelatino-peptizer contains less than 12 micromoles of non-alkylated methionine per gram.

10. A photographic emulsion according to claim 1 further characterized in that the gelatino-peptizer contains less than 5 micromoles of non-alkylated methionine per gram.

11. A photographic emulsion according to claim 1 wherein thin tabular silver bromide or bromoiodide grains having a thickness of less than 0.2 μm and an aspect ratio of greater than 5 account for greater than 50 percent of the total grain projected area of said emulsion, and the gelatino-peptizer contains less than 30 micromoles of methionine per gram.

12. A process comprising forming silver halide grains in the presence of a gelatino-peptizer under conditions which favor the formation of at least some grains containing twin planes, wherein the gelatino-peptizer initially contains methionine, characterized in that the methionine of the gelatino-peptizer is at least partially alkylated prior forming the silver halide grains, so that the proportion of twin plane containing grains formed is increased.

13. A process according to claim 12, further characterized in that the gelatino-peptizer present while the silver halide grains are being formed contains less than 30 micromoles of non-alkylated methionine per gram.

14. A process according to claim 13, further characterized in that the gelatino-peptizer present while the silver halide grains are being formed contains less than 12 micromoles of non-alkylated methionine per gram.

15. A process according to claim 12, further characterized in that the gelatino-peptizer present while the silver halide grains are being formed contains less than 5 micromoles of non-alkylated methionine per gram.

16. A process according to claim 12, further characterized in that the silver halide grains are formed under conditions which favor the formation of tabular grains.

17. A process according to claim 16, further characterized in that the halide forming the silver halide grains is comprised of bromide ions.

18. A process according to claim 17, further characterized in that the pBr within the reaction vessel is maintained in the range from 1.6 to 2.4 at the time that tabular grains are being formed.

19. A process according to claim 17, further characterized in that a minor portion of the halide forming the silver halide grains is iodide.

20. A process according to claim 16, further characterized in that the halide forming the silver halide grains is comprised of chloride ions.

21. A process according to claim 12, further characterized in that thhe gelatino-peiptizer is treated with the methyl iodide to lower its methionine content.

* * * * *